US009933736B2

(12) United States Patent
Furukawa

(10) Patent No.: US 9,933,736 B2
(45) Date of Patent: Apr. 3, 2018

(54) FIXING DEVICE AND IMAGE FORMING APPARATUS

(71) Applicant: KYOCERA Document Solutions Inc., Osaka (JP)

(72) Inventor: Noriaki Furukawa, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/433,278

(22) Filed: Feb. 15, 2017

(65) Prior Publication Data

US 2017/0255146 A1 Sep. 7, 2017

(30) Foreign Application Priority Data

Mar. 4, 2016 (JP) ..... 2016-042759

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/329
See application file for complete search history.

(56) References Cited

U.S. PATENT DOCUMENTS 5,765,086 A 6/1998 Kishino et al.
8,073,372 B2 * 12/2011 McNamee ..... G03G 15/20 399/323

FOREIGN PATENT DOCUMENTS

| | | | |
|---|---|---|---|
| JP | 2-13264 | | 1/1990 |
| JP | 2000137392 | A * | 5/2000 |
| JP | 2002268422 | A * | 9/2002 |
| JP | 2005049462 | A * | 2/2005 |
| JP | 2006106151 | A * | 4/2006 |
| JP | 2006184395 | A * | 7/2006 |
| JP | 2010204133 | A * | 9/2010 |
| JP | 2014224935 | A * | 12/2014 |

* cited by examiner

*Primary Examiner* — Susan Lee
(74) *Attorney, Agent, or Firm* — Wenderoth, Lind & Ponack, L.L.P.

(57) ABSTRACT

A fixing device includes a cap member mounted at an end portion of a fixing belt. The cap member has an outer cylindrical part that is fitted on an end portion of the fixing belt, an inner cylindrical part that is fitted into the end portion of the fixing belt, and a connection plate part that is positioned at an outer side of the axial direction from the end portion in the axial direction of the fixing belt and connects the inner cylindrical part and the outer cylindrical part. The fixing device further includes an electrode sheet that is provided between the inner cylindrical part and the fixing belt, and a plurality of vibrating bodies that are mounted at the electrode sheet so as to abut an inner peripheral surface of the fixing belt and are vibrated by receiving power through the electrode sheet.

7 Claims, 5 Drawing Sheets

Fig.5

| | Presence or absence of vibration plate | Thickness (m) of fixing belt elastic layer | Presence or absence of occurrence of uneven glossiness |
|---|---|---|---|
| Test example 1 | Presence | 200 | Absence |
| Test example 2 | Presence | 300 | Absence |
| Test example 3 | Absence | 200 | Presence |
| Test example 4 | Absence | 300 | Slight presence |

FIXING DEVICE AND IMAGE FORMING APPARATUS

CROSS-REFERENCE TO RELATED APPLICATION

This application is based upon and claims the benefit of priority from Japanese Patent Application No. 2016-042759 filed on Mar. 4, 2016, the entire contents of which are incorporated herein by reference.

BACKGROUND

The technology of the present disclosure relates to a fixing device and an image forming apparatus.

Conventionally, there has been known a fixing device provided with an endless fixing belt heated by a heating part and a pressure roller brought into press contact with the fixing belt. In this fixing device, when a recording paper passes through between the fixing belt and the pressure roller, toner on the recording paper is heated and pressed and is fixed to the recording paper.

In this type of fixing device, since a heating surface of the fixing belt is not able to follow unevenness (unevenness of the surface of the recording paper) of a toner layer formed on the recording paper, uneven heating occurs. As a consequence, glossiness becomes high in a part in which a heat transfer amount is large, that is, a part in which toner has been sufficiently molten, while glossiness becomes low in a part in which the heat transfer amount is small, that is, a part in which the toner has not been sufficiently molten. Therefore, there is a problem that uneven glossiness occurs in an image.

In order to cope with the problem, there has been proposed a fixing device in which the thickness of an elastic layer of an outer peripheral part of the fixing belt is set to be equal to or more than 100 μm. By so doing, the outer peripheral part of the fixing belt is allowed to follow the unevenness of the recording paper, so that it is possible to solve the aforementioned uneven glossiness problem.

Furthermore, there has also been proposed a fixing device in which vibration occurs in a nip portion serving as an abutting portion between a fixing roller and the pressure roller by vibrating a support shaft of the fixing belt by a ultrasonic generator.

SUMMARY

A fixing device according to one aspect of the present disclosure includes an endless fixing belt, a pressure roller, and a vibration generating unit. The pressure roller is brought into press contact with the fixing belt. The vibration generating unit generates vibration in a nip portion which is a contact portion between the fixing belt and the pressure roller.

Furthermore, the fixing device further includes a cap member mounted at an end portion of the fixing belt. The cap member has an outer cylindrical part, an inner cylindrical part, and a connection plate part. The outer cylindrical part is fitted on an end portion in an axial direction of the fixing belt. The inner cylindrical part is fitted into the end portion in the axial direction of the fixing belt. The connection plate part is positioned at an outer side of the axial direction from the end portion in the axial direction of the fixing belt. Furthermore, the connection plate part connects the inner cylindrical part and the outer cylindrical part.

The fixing device further includes an electrode sheet and a plurality of vibrating bodies. The electrode sheet is provided between the aforementioned inner cylindrical part and the fixing belt. The plurality of vibrating bodies are mounted at the electrode sheet so as to abut an inner peripheral surface of the fixing belt. The plurality of vibrating bodies are vibrated by receiving power through the electrode sheet.

BRIEF DESCRIPTION OF THE DRAWINGS

FIG. 5 is a table illustrating a test result obtained by variously changing the thickness of an elastic layer of a fixing belt and examining the presence or absence of the occurrence of uneven glossiness with respect to the case in which a vibrating body is provided and the case in which the vibrating body is not provided.

DETAILED DESCRIPTION

Hereinafter, an example of an embodiment will be described in detail on the basis of the drawings. It is noted that the technology of the present disclosure is not limited to the following embodiments.

Embodiment

Figure 1:
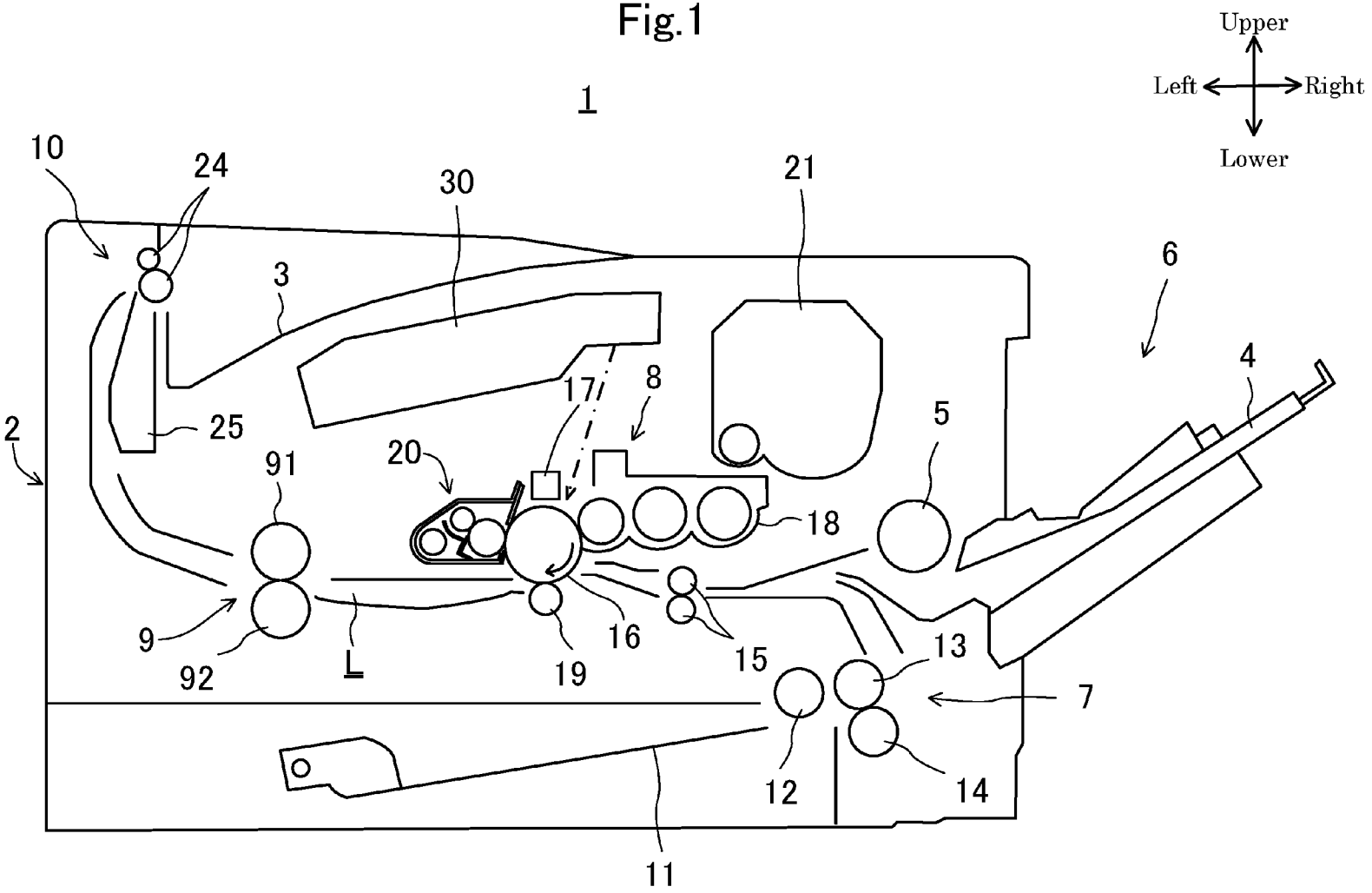
FIG. 1 is a schematic configuration diagram illustrating an image forming apparatus provided with a fixing device in an embodiment.

FIG. 1 is a sectional view illustrating a schematic configuration of a laser printer 1 as an image forming apparatus in the present embodiment. In the following description, a "front side" and a "rear side" respectively indicate a front side and a back side in a direction vertical to the paper surface of FIG. 1, and a "left side" and a "right side" respectively indicate a left side and a right side when the laser printer 1 is viewed from the front side.

As illustrated in FIG. 1, the laser printer 1 includes a box-like printer body 2, a manual paper feeding unit 6, a cassette paper feeding unit 7, an image forming unit 8, a fixing device 9, and a paper discharge unit 10. The laser printer 1 is configured to form an image on a paper on the basis of image data transmitted from a terminal (not illustrated) and the like while conveying the paper along a conveyance path L in the printer body 2.

The manual paper feeding unit 6 has a manual feed tray 4 provided at one side portion of the printer body 2 so as to be openable and closable, and a manual paper feeding roller 5 provided in the printer body 2 so as to be rotatable.

The cassette paper feeding unit 7 is provided at a bottom portion of the printer body 2. The cassette paper feeding unit 7 includes a paper feeding cassette 11 that stores a plurality of papers overlapped one another, a pick-up roller 12 that takes out the papers in the paper feeding cassette 11 one by one, and a feed roller 13 and a retard roller 14 that separate the taken-out papers one by one and send the separated paper to the conveyance path L.

The image forming unit 8 is provided above the cassette paper feeding unit 7 in the printer body 2. The image forming unit 8 includes a photosensitive drum 16 serving as an image carrying member and provided in the printer body 2 so as to be rotatable, a charging device 17, a developing part 18, a transfer roller 19, a cleaning part 20, and a laser scanning unit (LSU) 30 arranged above the photosensitive drum 16 to serve as an optical scanning device, wherein the charging device 17, the developing part 18, the transfer roller 19, and the cleaning part 20 are arranged around the photosensitive drum 16. Accordingly, the image forming unit 8 is configured to form an image on the paper supplied from the manual paper feeding unit 6 or the cassette paper feeding unit 7.

At the conveyance path L, a pair of resist rollers 15 are provided to temporarily keep the paper, which has been supplied from the manual paper feeding unit 6 or the cassette paper feeding unit 7, waiting and then supply the paper to the image forming unit 8 at a predetermined timing.

The fixing device 9 is arranged at a lateral side of the image forming unit 8. The fixing device 9 includes a fixing belt 91 and a pressure roller 92 which rotate while being brought into press contact with each other. Accordingly, the fixing device 9 fixes a toner image, which has been transferred to the paper in the image forming unit 8, to the paper.

The paper discharge unit 10 is provided above the fixing device 9. The paper discharge unit 10 includes a paper discharge tray 3, a paper discharge roller pair 24 for conveying the paper to the paper discharge tray 3, and a plurality of conveying guide ribs 25 for guiding the paper to the paper discharge roller pair 24. The paper discharge tray 3 is formed in a concave shape at an upper portion of the printer body 2.

When the laser printer 1 receives image data, the photosensitive drum 16 in the image forming unit 8 is rotationally driven and the charging device 17 charges the surface of the photosensitive drum 16.

Then, laser light is emitted from the laser scanning unit 30 to the photosensitive drum 16 on the basis of the image data. The surface of the photosensitive drum 16 is irradiated with the laser light, so that an electrostatic latent image is formed on the surface of the photosensitive drum 16. The electrostatic latent image formed on the photosensitive drum 16 is developed by toner charged in the developing device 18, so that the electrostatic latent image is visualized as a toner image.

The fixing device 9 includes the fixing belt 91 and the pressure roller 92 brought into press contact with an outer peripheral surface of the fixing belt 91. The pressure roller 92 is connected to a motor (not illustrated) and is rotationally driven by the motor. The fixing belt 91 is rotated according to the pressure roller 92. At a radial outside of the fixing belt 91, a heating part (not illustrated) is provided to heat the outer peripheral surface of the fixing belt 91. As the heating part, for example, an IH heater and the like using an induced current can be employed.

The fixing belt 91 is formed in an approximately cylindrical shape which is long in the front and rear direction. The fixing belt 91 is formed by stacking a metal base layer, an elastic layer, and a release layer in this order from a radial inside toward a radial outside. The elastic layer includes, for example, silicon rubber and the release layer includes, for example, fluororesin. In the present embodiment, the thickness of the elastic layer is set to be equal to or more than 200 μm and is equal to or less than 300 μm.

Figure 2:
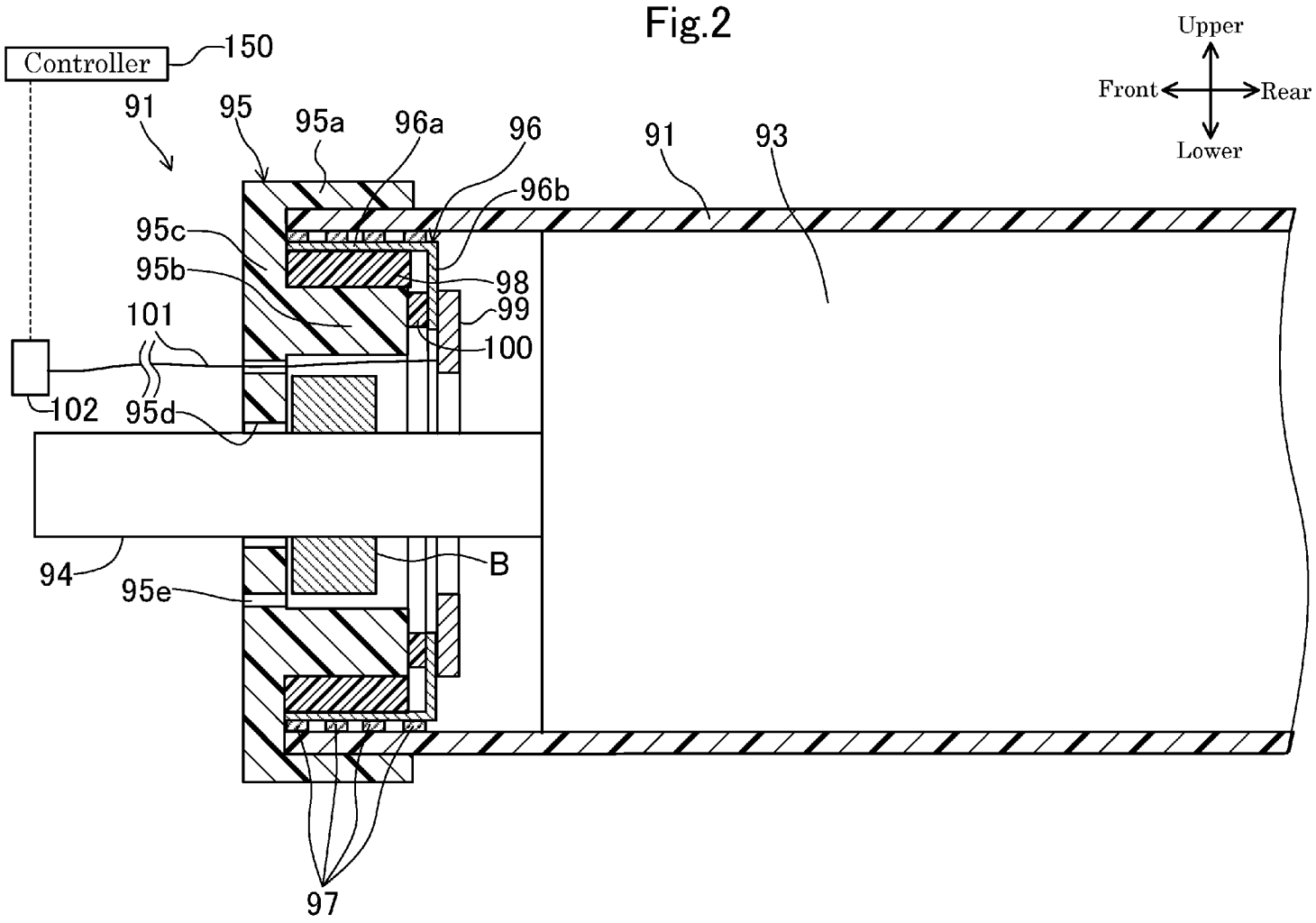
FIG. 2 is a sectional view taken along a rotating shaft direction of a fixing roller.

As illustrated in FIG. 2, the fixing belt 91 is wound around an outer peripheral surface of a cylindrical sponge roller 93 and is bonded to the sponge roller 93. There are hollow spaces at both end portions in an axial direction of the fixing belt 91 in a space at the radial inside of the fixing belt 91, and the sponge roller 93 is provided at an intermediate portion except for both end portions. A support shaft 94 passes through an axial center part of the sponge roller 93. Each of both end portions of the support shaft 94 is rotatably supported by a bearing B (in FIG. 2, only one bearing is illustrated).

The fixing belt 91 is mounted at both end portions in an axial direction thereof with cap members 95 (in FIG. 2, only one cap member 95 is illustrated).

The cap member 95 rotates together with the fixing belt 91. The rotation of the cap member 95 is detected by a speed detection sensor (not illustrated). Furthermore, the cap member 95 has an outer cylindrical part 95*a* fitted on the outer peripheral surface of the fixing belt 91. The shape of the outer peripheral surface of the fixing belt 91 is restricted to a cylindrical shape by the outer cylindrical part 95*a*. As described above, the cap member 95 has a function of maintaining the shape of the outer peripheral surface of the fixing belt 91 to the cylindrical shape and a function as a detection unit for detecting the rotation speed of the fixing belt 91. Moreover, in the present embodiment, the cap member 95 serves as a part of a vibration generating unit that generates vibration in the fixing belt 91.

That is, the cap member 95 has the outer cylindrical part 95*a* fitted on an end portion in the axial direction of the fixing belt 91, an inner cylindrical part 95*b* fitted into the end portion in the axial direction of the fixing belt 91, and a connection plate part 95*c* that connects the outer cylindrical part 95*a* and the inner cylindrical part 95*b*.

The outer cylindrical part 95*a* forms a cylindrical shape extending in the rotating shaft direction of the fixing belt 91. The inner cylindrical part 95*b* forms a cylindrical shape having a diameter smaller than that of the outer cylindrical part 95*a*. The inner cylindrical part 95*b* and the outer cylindrical part 95*a* are coaxially arranged with each other.

The connection plate part 95*c* is positioned at an outer side of the axial direction from the end portion in the axial direction of the fixing belt 91. The connection plate part 95*c* forms a disc shape vertical in the rotating shaft direction of the fixing belt 91. The connection plate part 95*c* is formed at a center portion thereof with a cylindrical through hole 95*d* through which the support shaft 94 of the sponge roller 93 passes. Between an end portion of the bearing B for supporting the support shaft 94 and the connection plate part 95*c*, a slight gap is provided. A proximal end portion of the outer cylindrical part 95*a* and a proximal end portion of the inner cylindrical part 95*b* are connected to a side surface of the connection plate part 95*c*. When viewed from the axial direction, the outer cylindrical part 95*a* and the inner cylindrical part 95*b* are arranged so as to surround the through hole 95*d* and form a concentric circular shape with respect to the through hole 95*d*.

Between an inner peripheral surface of the end portion in the axial direction of the fixing belt 91 and an outer peripheral surface of the inner cylindrical part 95*b* of the cap member 95, an electrode sheet 96 is provided. The electrode sheet 96 has a cylindrical sheet part 96*a* and a disc-shaped sheet part 96*b*.

The cylindrical sheet part 96*a* is formed in a cylindrical shape that surrounds the inner cylindrical part 95*b* of the cap member 95. An outer diameter of the cylindrical sheet part 96*a* is smaller than an inner diameter of the outer cylindrical part 95*a* of the cap member 95. An inner diameter of the cylindrical sheet part 96*a* is larger than an outer diameter of the inner cylindrical part 95*b*.

The disc-shaped sheet part 96*b* extends radially inside from an inner end portion (an end portion opposite to the connection plate part 95*c* side of the cap member 95) of a belt axial direction in the cylindrical sheet part 96*a*. The disc-shaped sheet part 96*b* is formed at a center portion thereof with a through hole through which the support shaft 94 passes. The disc-shaped sheet part 96*b* is configured with a conductive member and rotates integrally with the cylindrical sheet part 96*a*. Accordingly, the disc-shaped sheet part 96*b* serves as a rotating conductive part.

Figure 3:
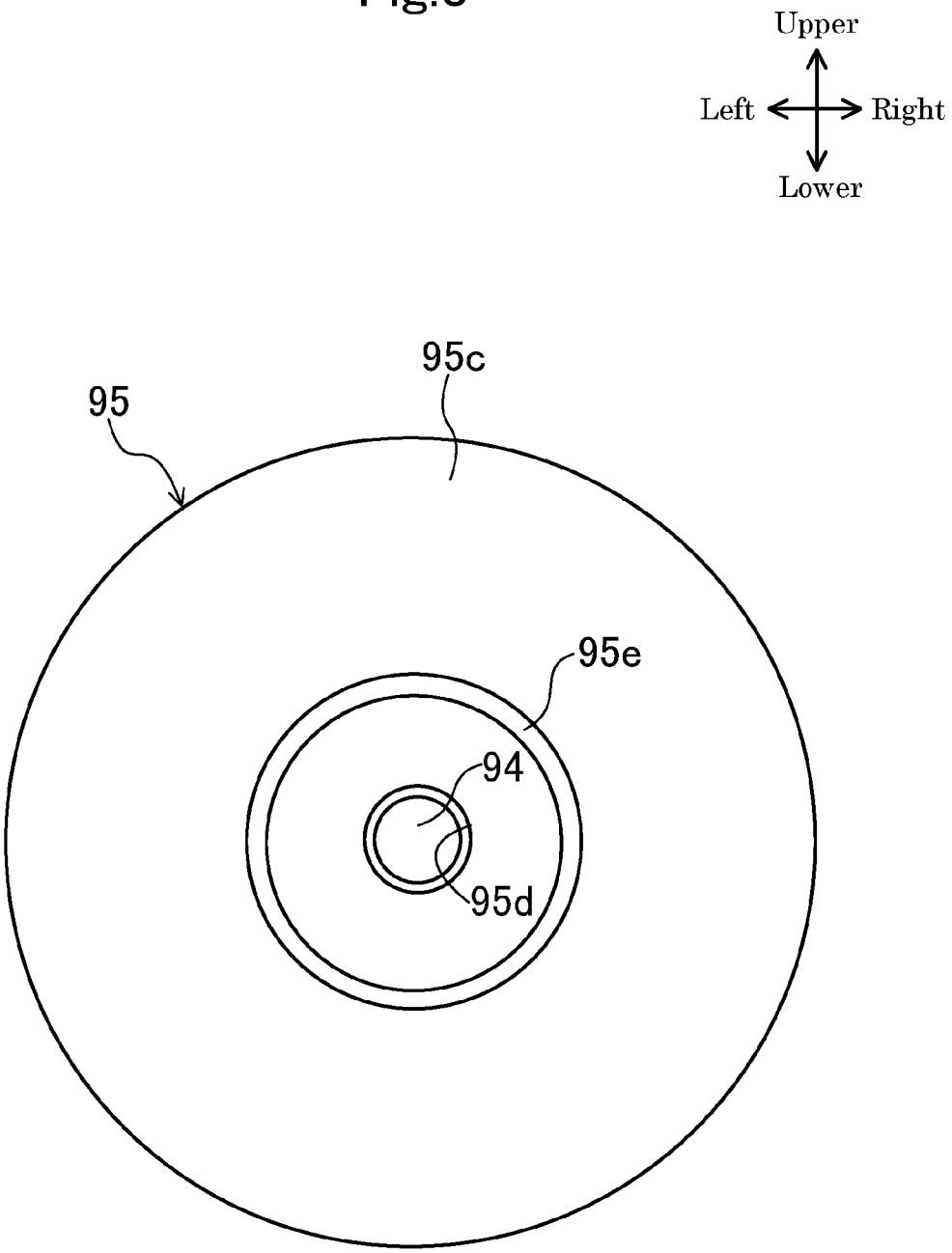
FIG. 3 is a view viewed in the arrow direction of III of FIG. 2.

A slip ring 99 serving as a stationary conductive part is in contact with an inner surface (a surface opposite to the connection plate part 95*c* side of the cap member 95) of a belt axial direction in the disc-shaped sheet part 96*b*. The slip ring 99 includes a hollow disc-shaped conductive member vertical to a rotating shaft of the fixing belt 91. The slip ring 99 is connected to a power supply 102 via a power supply wiring 101. The cap member 95 is formed at the connection plate part 95*c* thereof with a ring-shaped slit hole (a through hole) 95*e* through which the power supply wiring 101 passes (see FIG. 3).

Between the cylindrical sheet part 96*a* of the electrode sheet 96 and the inner cylindrical part 95*b* of the cap member 95, a cylindrical first pressing pad (a first pressing member) 98 is provided. The first pressing pad 98 is configured by an elastic member (for example, a rubber member) which is compressible in at least a radial direction. The first pressing pad 98 is arranged in a state of being sandwiched between the cylindrical sheet part 96*a* and the inner cylindrical part 95*b* and compressively deformed. The first pressing pad 98 presses the cylindrical sheet part 96*a* to a radial outside, thereby pressing vibrating bodies 97 (which will be described later), which are fixed to an outer peripheral surface of the cylindrical sheet part 96*a*, to the inner peripheral surface of the fixing belt 91.

Between the disc-shaped sheet part 96*b* of the electrode sheet 96 and the end surface of a projecting side of the inner cylindrical part 95*b* of the cap member 95, a hollow disc-shaped second pressing pad (a second pressing member) 100 is provided. The support shaft 94 of the sponge roller 93 passes through a hollow part of the second pressing pad 100. The second pressing pad 100 is configured by an elastic member (for example, a rubber member) which is compressible in at least a thickness direction. The second pressing pad 100 is arranged in a state of being sandwiched between the disc-shaped sheet part 96*b* and the inner cylindrical part 95*b* and compressively deformed. The second pressing pad 100 presses the disc-shaped sheet part 96*b* to the slip ring 99.

Figure 4:
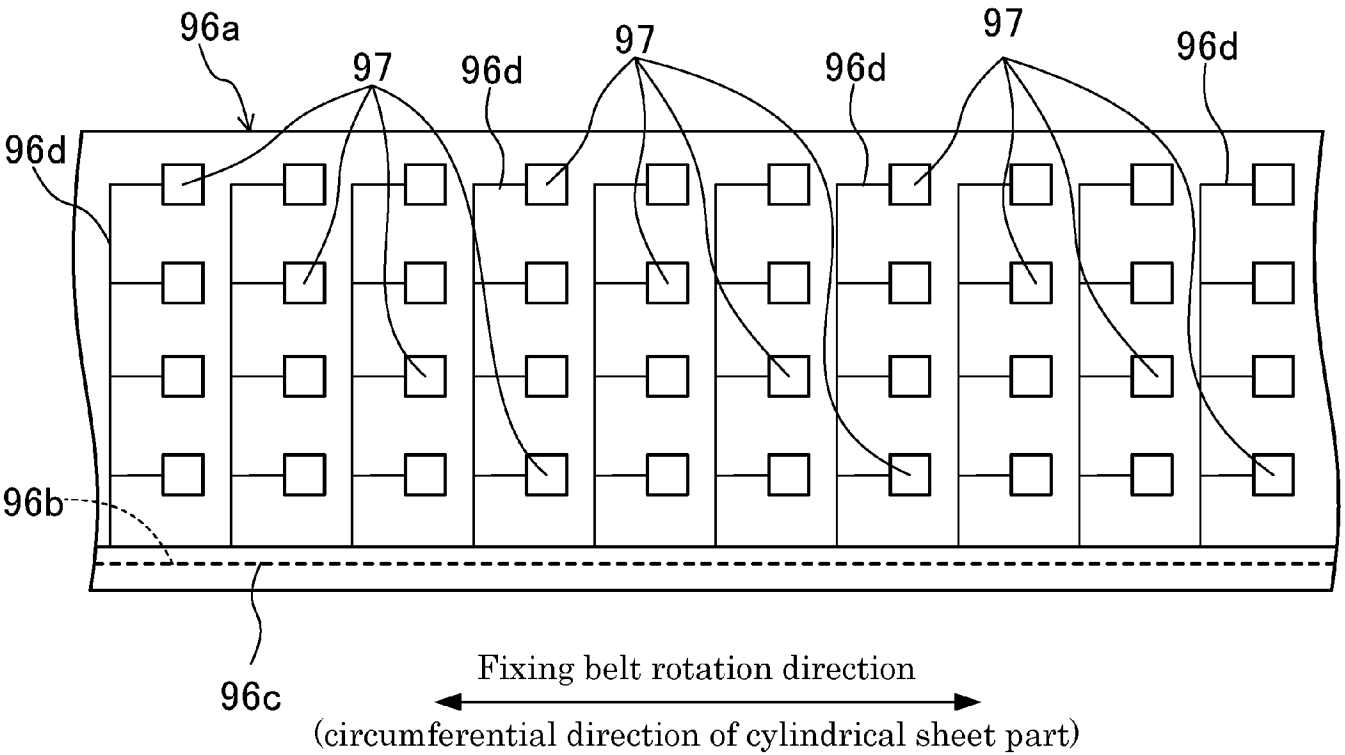
FIG. 4 is a schematic diagram when an electrode sheet is viewed from a radial inside.

As illustrated in FIG. 4, a plurality of vibrating bodies are fixed to the outer peripheral surface of the cylindrical sheet part 96*a*. The plurality of vibrating bodies 97 abut the inner peripheral surface of the end portion in the axial direction of the fixing belt 91. In the present embodiment, the plurality of vibrating bodies 97 are configured by piezoelectric elements, respectively. The plurality of vibrating bodies 97 are arranged at regular intervals in the circumferential direction and the axial direction of the cylindrical sheet part 96*a*. Each vibrating body 97 is electrically connected to a strip electrode 96*c*, which has been fixed to the outer peripheral surface of the cylindrical sheet part 96*a*, via a wiring 96*d*. The strip electrode 96*c* is provided at an end portion of the cylindrical sheet part 96*a*, which is opposite to the connection plate part 95*c* side of the cap member 95. The strip electrode 96*c* extends over the whole circumference of the cylindrical sheet part 96*a* and is connected to the whole circumferential edge of the disc-shaped sheet part 96*b*.

The power supply 102 (see FIG. 2) is electrically connected to a controller 150. During the execution of a fixing process, the controller 150 rotates the pressure roller 92 and the fixing belt 91 by rotating a driving motor of the pressure roller 92, and supplies power to the slip ring 99 from the power supply 102 via the power supply wiring 101.

Consequently, in the fixing device 9, when the fixing process is started by the controller 150, the fixing belt 91 is rotated according to the rotation of the pressure roller 92. Accordingly, the cap member 95 mounted at the end portion of the fixing belt 91 is rotated, and the electrode sheet 96 and the vibrating bodies 97, which are provided between the outer cylindrical part 95*a* and the inner cylindrical part 95*b* of the cap member 95, are rotated together with the cap member 95. The disc-shaped sheet part 96*b* of the electrode sheet 96 is rotated in contact with the slip ring 99. The slip ring 99 receives power from the power supply 102 via the power supply wiring 101, and the supplied power is supplied to the plurality of vibrating bodies 97 via the slip ring 99→the disc-shaped sheet part 96*b*→the strip electrode 96*c* (see FIG. 4) of the cylindrical sheet part 96*a*→the wiring 96*d*. As a consequence, the plurality of vibrating bodies 97 vibrate, so that this vibration is transferred to the fixing belt 91. The vibration frequency of the vibrating body 97 can be controlled by changing a power frequency by the controller 150.

The vibration transferred to the fixing belt 91 by the vibrating bodies 97 is transferred to a nip portion between the fixing belt 91 and the pressure roller 92. Then, the vibration is transferred to a recording paper P passing through the nip portion, so that it is possible to allow a toner layer on the recording paper P to follow the surface unevenness of the recording paper P. By so doing, the toner layer following the unevenness of the recording paper P makes close contact with the fixing belt 91, so that it is possible to uniformize a heat amount transferred to the toner layer regardless of the unevenness. Thus, it is possible to solve uneven glossiness (uneven concentration) of a toner image that is fixed to the recording paper P.

Furthermore, in the present embodiment, the elastic layer of the fixing belt 91 is set to be equal to or more than 200 μm. Thus, the thickness of the fixing belt 91 is set to be larger than usual, so that the outer peripheral portion of the fixing belt 91 is allowed to easily follow the unevenness of the recording paper P. Consequently, a heat amount transferred to the toner layer by the fixing belt 91 is further uniformized, so that it is possible to suppress the occurrence of uneven glossiness. However, when the elastic layer is excessively thick, since the heat capacity of the fixing belt 91 becomes excessively large, a time until the fixing belt 91 is heated to a target temperature becomes long, so that the startup time of the fixing device 9 becomes long.

In this regard, in the aforementioned embodiment, the elastic layer of the fixing belt 91 is limited to be equal to or less than 300 μm and instead, the fixing belt 91 is allowed to be vibrated by the vibrating bodies 97, so that the occurrence of uneven glossiness of the recording paper P is suppressed while shortening the startup time of the fixing device 9.

In addition, in the aforementioned embodiment, the vibrating bodies 97 are allowed to directly contact with the fixing belt 91, so that it is possible to reliably vibrate the fixing belt 91 as compared with the case in which the support shaft 94 of the fixing belt 91 is allowed to vibrate for example. Thus, it is possible to more reliably achieve the aforementioned suppression effect of the uneven glossiness.

Furthermore, the plurality of vibrating bodies 97 are provided on the outer peripheral surface of the cylindrical sheet part 96*a* of the electrode sheet 96, so that it is possible to easily bend the cylindrical sheet part 96*a* as compared with the case in which the vibrating bodies 97, for example, are configured with one member. Thus, assembling work when the electrode sheet 96 is assembled to the fixing device 9 is facilitated.

Furthermore, in the aforementioned embodiment, the first pressing pad 98 is provided between the cylindrical sheet part 96*a* of the electrode sheet 96 and the inner cylindrical part 95*b* of the cap members 95, so that it is possible to always press the plurality of vibrating bodies 97 to the inner peripheral surface of the fixing belt 91 at prescribed pressure by elastic force of the first pressing pad 98. Thus, it is possible to reliably transfer vibration of the plurality of vibrating bodies 97 to the fixing belt 91.

Furthermore, in the aforementioned embodiment, the second pressing pad 100 is configured to be provided between the disc-shaped sheet part (a rotating conductive part) 96*b* of the electrode sheet 96 and an end surface of the inner cylindrical part 95*b* of the cap member 95, which is opposite to the connection plate part 95*c* side. By so doing, during the rotation of the fixing belt 91, it is possible to reliably press the disc-shaped sheet part 96*b* to the slip ring 99 by elastic force of the second pressing pad 100. Thus, it is possible to prevent vibration failure of the vibrating bodies 97 from occurring due to blocking of a power supply path from the power supply 102 to the vibrating bodies 97.

Moreover, in the aforementioned embodiment, the vibrating body 97 includes a piezoelectric element. By so doing, the power frequency of the power supply 102 is simply changed by the controller 150, so that it is possible to change the vibration frequency of the vibrating body 97. Thus, it is possible to easily perform vibration frequency control of the vibrating body 97.

FIG. 5 is a table illustrating a test result obtained by examining the presence or absence of the occurrence of uneven glossiness by using the fixing device 9 of the aforementioned embodiment. According to the table, in both cases in which the thickness of the elastic layer of the fixing belt 91 is 200 μm and 300 μm, it can be understood that the occurrence of the uneven glossiness is suppressed by providing the vibrating bodies 97.

Other Embodiments

In the aforementioned embodiment, the example in which the fixing belt 91 is heated radially outside by the IH heater has been described; however, the invention is not limited thereto and the heater may be provided radially inside of the fixing belt 91.

What is claimed is:

1. A fixing device including an endless fixing belt, a pressure roller that is brought into press contact with the fixing belt, and a vibration generating unit that generates vibration in a nip portion which is a contact portion between the fixing belt and the pressure roller, wherein the fixing device further comprises a cap member mounted at an end portion of the fixing belt, the cap member has:

an outer cylindrical part that is fitted on an end portion in an axial direction of the fixing belt, an inner cylindrical part that is fitted into the end portion in the axial direction of the fixing belt; and a connection plate part that is positioned at an outer side of the axial direction from the end portion in the axial direction of the fixing belt and connects the inner cylindrical part to the outer cylindrical part, and the vibration generating unit has:

an electrode sheet that is provided between the inner cylindrical part and the fixing belt; and a plurality of vibrating bodies that are mounted at the electrode sheet so as to abut an inner peripheral surface of the fixing belt and are vibrated by receiving power through the electrode sheet.

2. The fixing device of claim 1, further comprising:

a first pressing member that is provided between the electrode sheet and the inner cylindrical part and presses the electrode sheet to an inner peripheral surface side of the fixing belt.

3. The fixing device of claim 1, wherein the electrode sheet forms a cylindrical shape that surrounds a rotating shaft of the fixing belt and is configured to be rotated by frictional force, which is generated between the electrode sheet and the fixing belt, together with the fixing belt, a rotating conductive part is formed over a whole circumference of an end portion of the electrode sheet, which is opposite to a connection plate part side, extends toward a radial inside, and rotates together with the electrode sheet, the fixing device further comprises:

a stationary conductive part that slidably contacts with the rotating conductive part; and a power supply wiring connected to the connection plate part, and the connection plate part is formed with a through hole through which the power supply wiring passes.

4. The fixing device of claim 3, further comprising:

a pressing member that is provided between an end portion of the inner cylindrical part, which is opposite to the connection plate part side, and presses the rotating conductive part to a side of the stationary conductive part.

5. The fixing device of claim 1, wherein the plurality of vibrating bodies include piezoelectric elements, respectively.

6. The fixing device of claim 1, wherein an outer peripheral surface side of the fixing belt is formed with an elastic layer, and a thickness of the elastic layer is equal to or more than 200 μm and is equal to or less than 300 μm.

7. An image forming apparatus including the fixing device of claim 1.

* * * * *